US011684156B1

(12) United States Patent
Stempky et al.

(10) Patent No.: US 11,684,156 B1
(45) Date of Patent: Jun. 27, 2023

(54) MODULAR DRAWER GUIDES FOR SLIDING DRAWERS

(71) Applicant: Haier US Appliance Solutions, Inc., Wilmington, DE (US)

(72) Inventors: Lydia Stempky, Louisville, KY (US); John Adam Yantis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/667,896

(22) Filed: Feb. 9, 2022

(51) Int. Cl.
*A47B 88/41* (2017.01)
*F24C 15/16* (2006.01)
*A47B 88/437* (2017.01)

(52) U.S. Cl.
CPC ..... *A47B 88/41* (2017.01); *A47B 88/437* (2017.01); *F24C 15/16* (2013.01); *A47B 2210/0037* (2013.01); *A47B 2210/0043* (2013.01); *A47B 2210/0056* (2013.01); *A47B 2210/17* (2013.01)

(58) Field of Classification Search
CPC ... A47B 88/41; A47B 88/0411; A47B 88/413; A47B 88/437; A47B 88/0466; A47B 88/487; A47B 88/14; A47B 2088/0496; A47B 2210/0037; A47B 2210/004; A47B 2210/0043; A47B 2210/0445; A47B 2210/0051; A47B 2210/17; A47B 2210/0056; F24C 15/16
See application file for complete search history.

(56) References Cited

U.S. PATENT DOCUMENTS

| | | | | | |
|---|---|---|---|---|---|
| 732,721 | A * | 7/1903 | Dunning | 312/334.26 | |
| 1,866,853 | A * | 7/1932 | Kennedy | A47B 88/417 312/334.15 | |
| 2,155,654 | A | 4/1939 | Haley | | |
| 2,255,290 | A | 9/1941 | Kennedy | | |
| 3,015,532 | A * | 1/1962 | Wilson | A47B 88/487 312/334.41 | |
| 3,375,051 | A * | 3/1968 | Andersen | A47B 88/487 312/334.41 | |
| 4,389,079 | A * | 6/1983 | Cosme | A47B 88/483 312/334.36 | |
| 4,412,703 | A * | 11/1983 | Simonson | A47B 88/483 384/21 | |
| 4,420,197 | A * | 12/1983 | Dreiling | A47B 88/487 312/334.41 | |
| 4,427,246 | A * | 1/1984 | MacDonald | A47B 88/41 312/334.43 | |

(Continued)

FOREIGN PATENT DOCUMENTS

| | | |
|---|---|---|
| CN | 201839740 U | 5/2011 |
| CN | 205037371 U | 2/2016 |

(Continued)

*Primary Examiner* — Andrew M Roersma
(74) *Attorney, Agent, or Firm* — Dority & Manning, P.A.

(57) ABSTRACT

A drawer assembly for an appliance includes a front drawer guide fixed to a frame of the appliance including a front slide, the front slide defining a first sliding surface and a first receiving channel, a drawer body in slidable contact with the front drawer guide, and a rear drawer guide coupled to the drawer body, the rear drawer guide including a hook and a rear slide provided over the hook along the vertical direction, the rear slide defining a second sliding surface and a second receiving channel.

18 Claims, 7 Drawing Sheets

(56) References Cited

U.S. PATENT DOCUMENTS

| | | | | | |
|---|---|---|---|---|---|
| 4,534,600 | A * | 8/1985 | Cosme | A47B 88/483 | |
| | | | | 384/23 | |
| 4,620,801 | A * | 11/1986 | MacDonald | A47B 88/487 | |
| | | | | 384/19 | |
| 8,610,035 | B2 | 12/2013 | Yoshidome | | |
| 9,599,349 | B2 * | 3/2017 | Gluf | F24C 15/16 | |
| 9,752,823 | B2 | 9/2017 | Klitzing et al. | | |
| 11,457,737 | B1 * | 10/2022 | Stempky | A47B 88/403 | |

FOREIGN PATENT DOCUMENTS

| | | | | |
|---|---|---|---|---|
| DE | 10253158 | B4 | 1/2008 | |
| DE | 202009000665 | U1 * | 7/2010 | A47B 88/40 |
| DE | 102012221735 | A1 * | 5/2014 | A47B 88/487 |
| EP | 1764012 | A1 * | 3/2007 | A47B 88/04 |
| EP | 2581667 | B1 | 7/2017 | |

* cited by examiner

MODULAR DRAWER GUIDES FOR SLIDING DRAWERS

FIELD OF THE INVENTION

The present subject matter relates generally to drawer guides, and more particularly to modular drawer guides including multiple operational configurations.

BACKGROUND OF THE INVENTION

Conventional ovens are household appliances used to cook or reheat food items or cooking utensils, such as baking dishes or pans. Users may store certain cooking utensils in convenient places for ease of access. For instance, some conventional ovens include a drawer underneath an oven cavity, such as to store pots, pans, or other utensils. The drawer may be configured to slide into and away from a space below the oven cavity, for instance, along one or more rails. Accordingly, certain features, such as drawer slides or guides, that aid in the sliding ability of the drawer are required.

Existing guides for aiding in the sliding of drawers exhibit certain drawbacks. For instance, conventional guides are highly susceptible to wear, damage, and failure due to increased part-on-part contact. Moreover, a higher friction level between parts increases a force required to withdraw the drawer from the drawer space. Conventional drawer guides also offer a single operational configuration, reducing modularity and customization for required or desired applications. Finally, maintenance of conventional drawer guides can be tedious and time consuming. Accordingly, a drawer guide with features that obviate one or more of the aforementioned drawbacks would be useful. In particular, a drawer guide with multiple operational configurations and increased smoothness would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a drawer assembly for an appliance is provided. The appliance may define a vertical direction, a lateral direction, and a transverse direction, and may include a frame defining an opening. The drawer assembly may include a front drawer guide fixed to the frame of the appliance proximate the opening, the front drawer guide including a front slide, wherein the front slide defines a first sliding surface and a first receiving channel defined within the sliding surface; a drawer body including a rear panel, wherein the drawer body is in slidable contact with the first sliding surface; and a rear drawer guide coupled to the drawer body, the rear drawer guide including an alignment flange and a rear slide provided above the alignment flange along the vertical direction, wherein the rear slide defines a second sliding surface and a second receiving channel.

In another exemplary aspect of the present disclosure, an oven appliance is provided. The oven appliance may include a cabinet defining a cooking chamber and a drawer recess provided beneath the cooking chamber; a frame member extending along the transverse direction within the drawer recess; and a drawer assembly removably provided within the drawer recess. The drawer assembly may include a front drawer guide fixed to the frame member proximate a front of the oven appliance, the front drawer guide including a front slide, wherein the front slide defines a first sliding surface and a first receiving channel; a drawer body including a rear panel, wherein the drawer body is in slidable contact with the front drawer guide; and a rear drawer guide coupled to the drawer body, the rear drawer guide including a hook and a rear slide provided over the hook along the vertical direction, wherein the rear slide defines a second sliding surface and a second receiving channel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
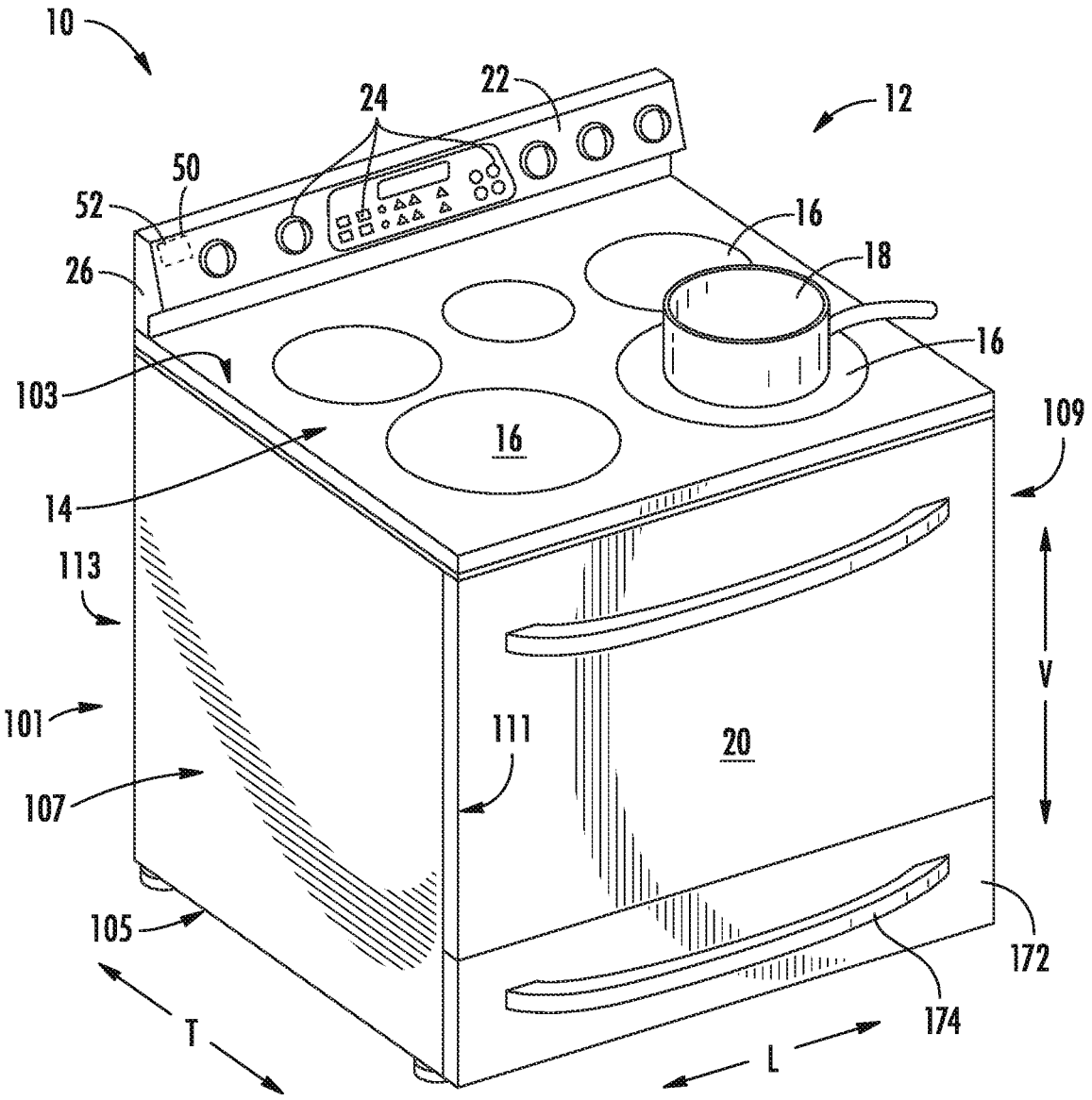
FIG. 1 provides a perspective view of an oven range according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
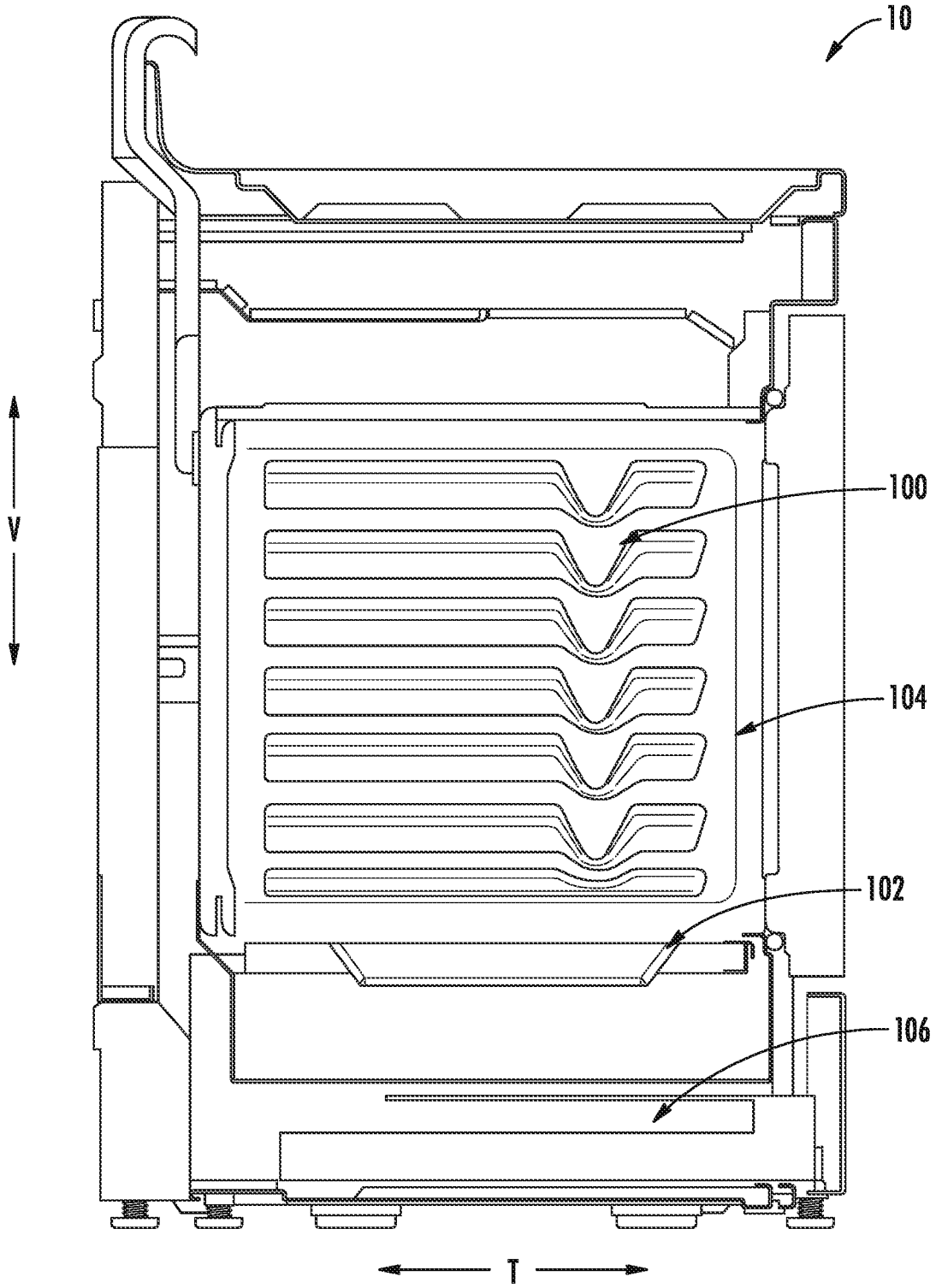
FIG. 2 provides a side cut-away view of the exemplary oven range of FIG. 1.

FIG. 1 provides a perspective view of a range appliance, or oven range 10, including a cooktop 12, and FIG. 2 provides a side cut-away view of the range appliance. Oven range 10 is provided by way of example only and is not intended to limit the present subject matter to the arrangement shown in FIGS. 1 and 2. Thus, the present subject matter may be used with other range 10 and/or cooktop 12 configurations, e.g., double oven range appliances. As illustrated, oven range 10 generally defines a vertical direction V, a lateral direction L, and a transverse direction T, each of which is mutually perpendicular, such that an orthogonal coordinate system is generally defined. Oven range 10 includes a cabinet 101 that extends between a top 103 and a bottom 105 along the vertical direction V, between a left side 107 and a right side 109 along the lateral direction, and between a front 111 and a rear 113 along the transverse direction T.

A cooking surface 14 of cooktop 12 includes a plurality of heating elements 16. For the embodiment depicted, the cooktop 12 includes five heating elements 16 spaced along cooking surface 14. The heating elements 16 are generally electric heating elements and are positioned at, e.g., on or proximate to, the cooking surface 14. In certain exemplary embodiments, cooktop 12 may be a radiant cooktop with resistive heating elements or coils mounted below cooking surface 14. However, in other embodiments, the cooktop appliance 12 may include any other suitable shape, configuration, and/or number of heating elements 16, for example, the cooktop 12 may be an open coil cooktop with the heating elements 16 positioned on or above surface 14. Additionally, in other embodiments, the cooktop 12 may include any other suitable type of heating element 16, such as an induction heating element. Each of the heating elements 16 may be the same type of heating element 16, or cooktop 12 may include a combination of different types of heating elements 16.

As shown in FIG. 1, a cooking utensil 18, such as a pot, pan, or the like, may be placed on a heating element 16 to heat the cooking utensil 18 and cook or heat food items placed in cooking utensil 18. Range appliance 10 also includes a door 20 that permits access to a cooking chamber 104 of oven range 10, e.g., for cooking or baking of food items therein. A control panel 22 having controls 24 permits a user to make selections for cooking of food items. Although shown on a backsplash or back panel 26 of oven range 10, control panel 22 may be positioned in any suitable location. Controls 24 may include buttons, knobs, and the like, as well as combinations thereof, and/or controls 24 may be implemented on a remote user interface device such as a smartphone, as described below. As an example, a user may manipulate one or more controls 24 to select a temperature and/or a heat or power output for each heating element 16 and the cooking chamber 104. The selected temperature or heat output of heating element 16 affects the heat transferred to cooking utensil 18 placed on heating element 16.

The cooktop appliance 12 includes a control system 50 for controlling one or more of the plurality of heating elements 16 and the cooking chamber 104. Specifically, the control system 50 may include a controller 52 operably connected to the control panel 22 and controls 24. The controller 52 may be operably connected to each of the plurality of heating elements 16 for controlling a power supply to each of the plurality of heating elements 16 in response to one or more user inputs received through the control panel 22 and controls 24.

The cooktop appliance 12 may include a drawer recess 106, into which a drawer assembly 108 (described in more detail below) may be inserted. Drawer recess 106 may be provided underneath cooking chamber 104, for example. A user may store various items (e.g., cooking utensils 18 or the like) within drawer recess 106. Additionally or alternatively, drawer recess 106 may be used as a temporary storage area for food (e.g., as a warming zone or area). According to some embodiments, drawer recess 106 may be an additional cooking or baking zone, in which food items may be cooked or baked. It should be noted that drawer recess 106 may be used for any suitable purposes, and the disclosure is not limited to those examples given herein. An opening to drawer recess 106 may be defined in the lateral direction L and vertical direction V. In detail, drawer recess 106 may be configured such that drawer assembly 108 is withdrawn in the transverse direction T from drawer recess 106.

Figure 7:
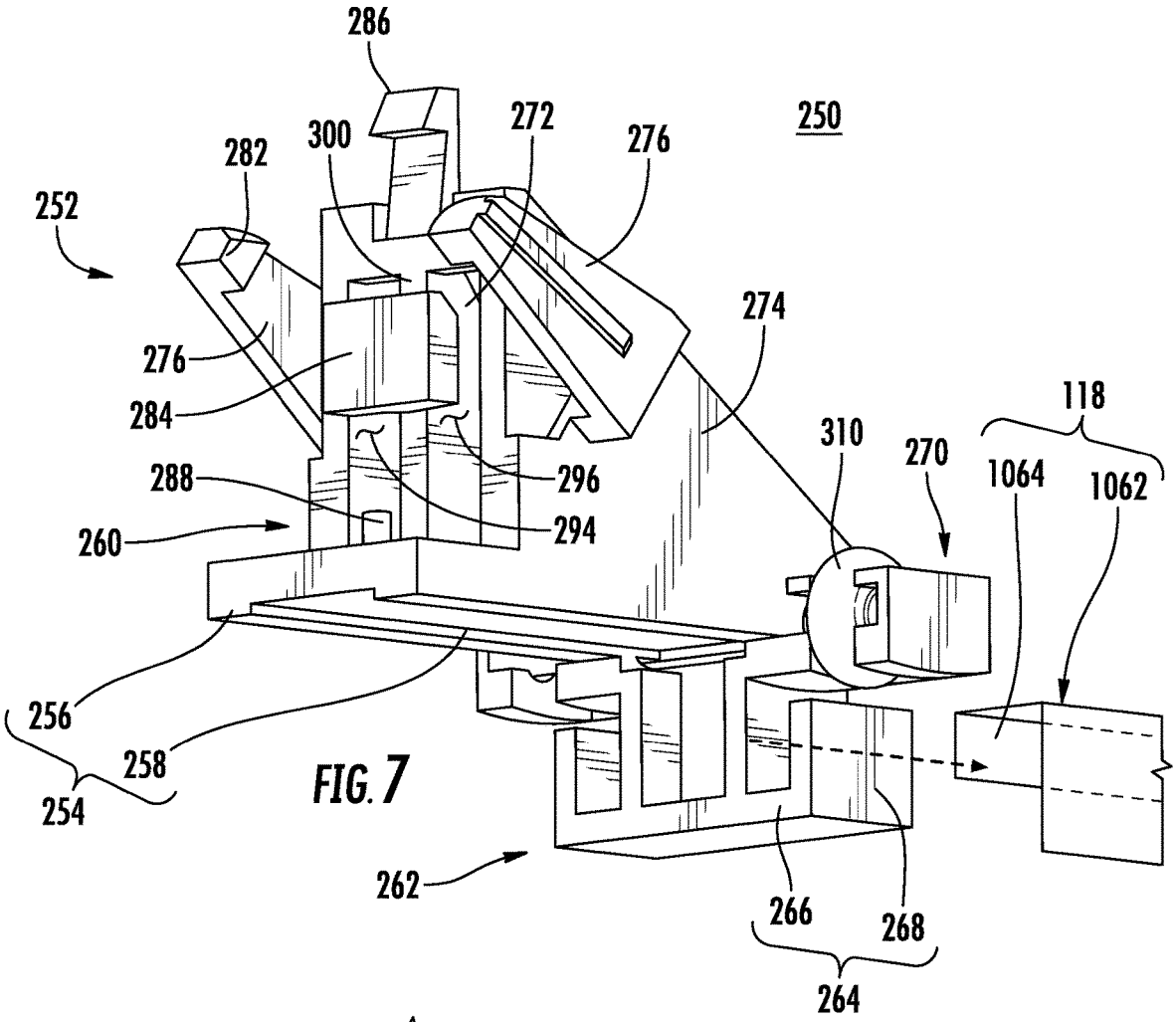
FIG. 7 provides a perspective view of a rear drawer guide according to exemplary embodiments of the present disclosure.
Figure 9:
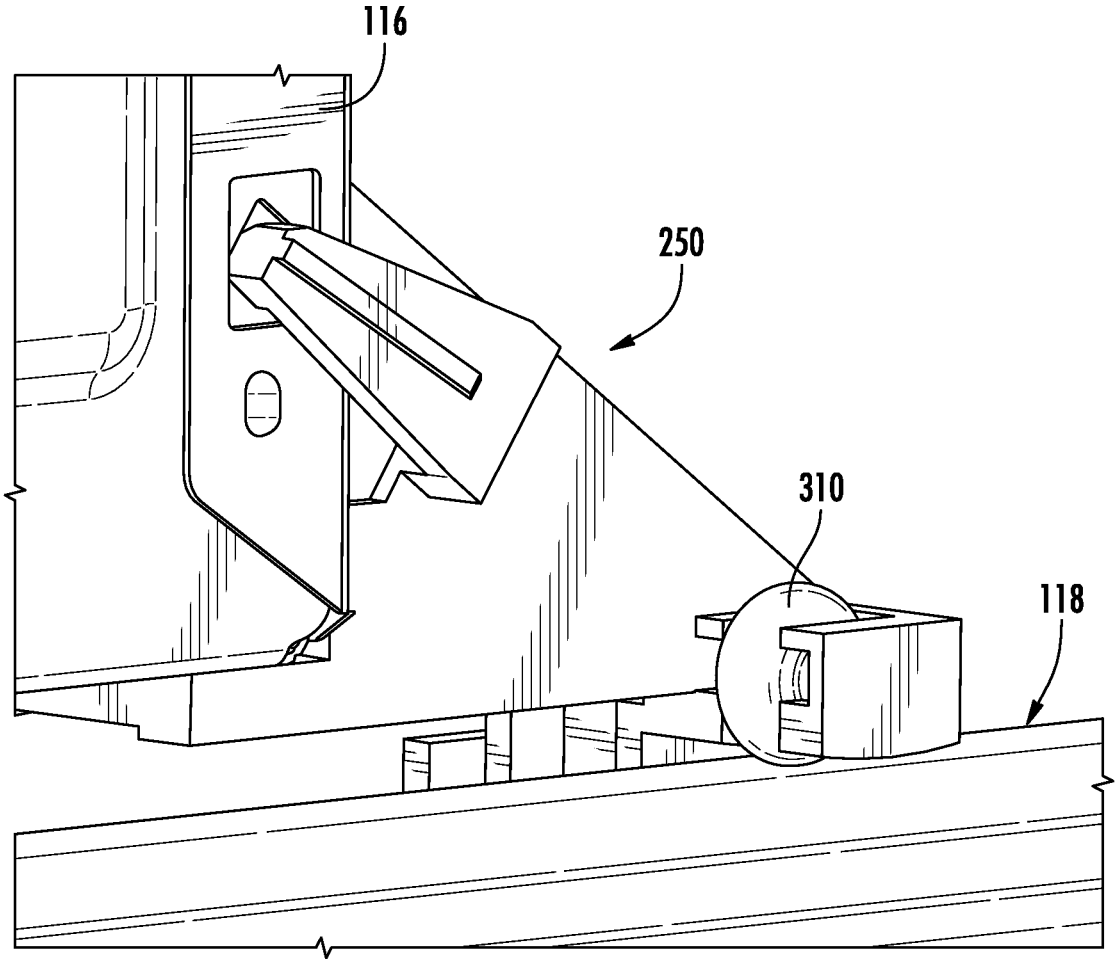
FIG. 9 provides a perspective view of the exemplary rear drawer guide of FIG. 6 in an installed position.

One or more drawer slide rails 118 may be located within drawer recess 106 (e.g., as seen in FIGS. 7 and 9). For example, drawer slide rail 118 may be attached to cabinet 101 (e.g., a frame of cabinet 101). In some embodiments, drawer slide rail 118 is formed as a part of cabinet 101. Drawer slide rail 118 may be arranged in the transverse direction T. In other words, drawer slide rail 118 may be orientated such that drawer assembly 108 slides along drawer slide rail 118 along the transverse direction T. The one or more drawer slide rails 118 may include a first drawer slide rail 118 provided at a first lateral side of drawer recess 106 and a second drawer slide rail 118 provided at a second lateral side of drawer recess 106. However, it should be appreciated that any suitable number of drawer slide rails 118 may be provided within drawer recess 106.

Drawer slide rail 118 may include a horizontal portion 1062 and a vertical portion 1064. Horizontal portion 1062 may protrude in the lateral direction L and extend in the transverse direction T. Vertical portion 1064 may protrude from a distal end of horizontal portion 1062 in the vertical direction V (e.g., downward), and extend in the transverse direction T. Accordingly, drawer slide rail may have an "L" shaped cross-section in a plane defined in the lateral direction L and the vertical direction V.

Drawer assembly 108 may include a main panel 110, a rear panel 112, a first side panel 114, and a second panel 116. Accordingly, main panel 110, rear panel 112, first side panel 114, and second side panel 116 may form a drawer body 109 having a cuboid shape into which various items may be placed. It should be noted that drawer body 109 may be formed from a single piece and bent into the cuboid shape according to certain embodiments. Drawer assembly 108 may include a front panel or door face 172 including a handle 174 (FIG. 1) used to withdraw and insert drawer assembly 108 into drawer recess 106. When assembled, first side panel 114 and second side panel 116 may be defined in the transverse direction T and the vertical direction V. Rear panel 112 may be defined in the lateral direction L and the vertical direction V. Main panel 110 may be defined in the lateral direction L and the transverse direction T. A rear portion of each of first side panel 114 and second side panel 116 may extend further in the transverse direction T than a position of rear panel 112. In other words, each of first side panel 114 and second side panel 116 may define an overhang or extension in the transverse direction (e.g., behind rear panel 112 in the transverse direction T, as seen in FIG. 7).

Figure 3:
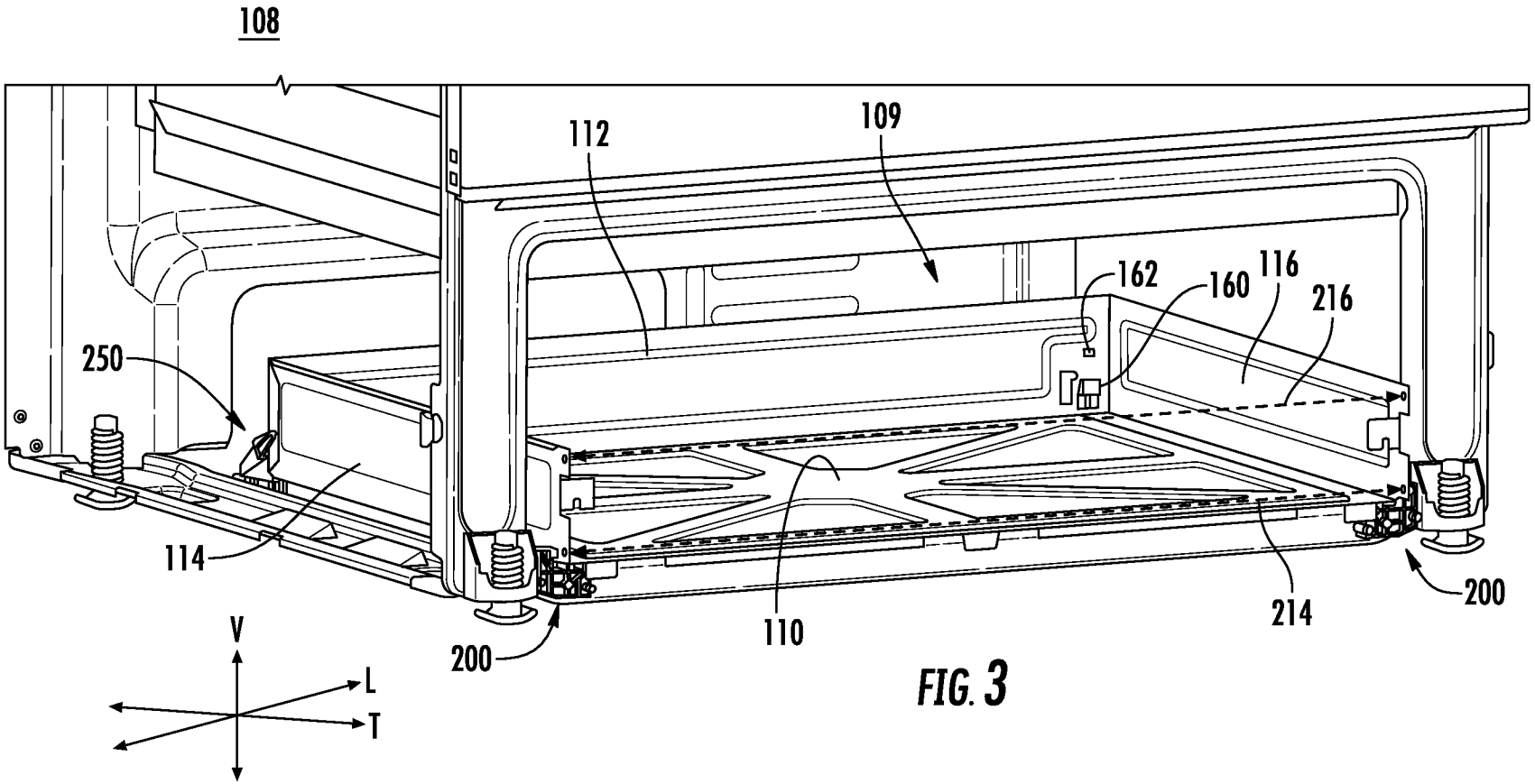
FIG. 3 provides a perspective cut-away view of a drawer assembly of the exemplary oven range of FIG. 1.

A latch hole 160 may be defined in rear panel 112 of drawer body 109. Latch hole 160 may be configured to accept and hold a first protrusion 284 (described below) of a rear drawer guide 250 (also described below). As best seen in FIG. 3, latch hole 160 may be located at or near a bottom of rear panel 112. Latch hole 160 may be predominantly square in shape. Additionally or alternatively, latch hole 160 may include one or more tabs that protrude from a top corner of latch hole 160 in the lateral direction L and vertical direction V. However, the geometry of latch hole 160 is not limited to that discussed herein, and any suitable shape may be used.

A catch hole 162 may be defined in rear panel 112 of drawer body 109. Catch hole 162 may be positioned above latch hole 160 (e.g., along the vertical direction V). Catch hole 162 may be configured to accept a second protrusion 156 (described below) of rear drawer guide 120. Catch hole 162 may be predominantly square in shape. However, the geometry of catch hole 162 is not limited to that discussed herein, and any suitable shape may be used.

Drawer assembly 108 may include a front drawer guide 200. In particular, as shown in FIGS. 3 through 6, front drawer guide 200 may be attached to cabinet 101 (e.g., adjacent to drawer recess 106). Front drawer guide 200 may include first and second front drawer guides 200 (or left and right front drawer guides, according to some embodiments). In other words, a first front drawer guide 200 may be provided at or near a lower left corner of drawer recess 106, proximate front 111 and bottom 105 of cabinet 101. Similarly, a second front drawer guide 200 may be provided at or near a lower right corner of drawer recess 106, proximate front 111 and bottom 105 of cabinet 101. Drawer body 109 may be supported by front drawer guide 200. For instance, drawer body 109 may be withdrawn from drawer recess 106 while remaining in contact with front drawer guide 200. Moreover, front drawer guide 200 may include a front slide 220. As will be explained in further detail below, the contact between drawer body 109 and front drawer guide 200 may be rolling, sliding, or a combination thereof.

Front drawer guide 200 may include a main body 202. Main body 202 may have an "L" shape, including a vertical portion 204 and a lateral portion 208. In detail, the vertical portion 204 may extend from the lateral portion 208, forming a pocket between a top surface 206 of the lateral portion 208 and a side surface 210 of the vertical portion 204. Accordingly, main panel 110 may contact top surface 206 and first side panel 114 may contact side surface 210.

Side surface 210 may include a lateral support surface or tab 212. For instance, lateral support surface 212 may protrude from side surface 210 along the lateral direction L (e.g., toward drawer body 109). Lateral support surface 212 may be in sliding contact with drawer body 109 (e.g., first side panel 114 and/or second side panel 116). According to at least some embodiments, first and second front drawer guides 200 each have a lateral support surface 212, such that the first and second lateral support surfaces 212 face each other along the lateral direction L. Accordingly, a width 214 between the first and second lateral support surfaces 212 may be greater than a lateral length 216 of drawer body 109. For instance, the width 214 between the first and second lateral support surfaces 212 may be 1% to 5% greater than the lateral length 216 of drawer body 109. Thus, drawer body 109 may be stably supported by the first and second front drawer guides 200 along the lateral direction L.

As described above, front drawer guide 200 may include a front slide 220. In detail, front slide 220 may include a first sliding surface 222 upon which drawer body 109 (e.g., main panel 110) slides. Front slide 220 may extend (e.g., along the vertical direction V) from top surface 206 of lateral portion 208. Accordingly, front slide 220 may be spaced upward (e.g., along the vertical direction V) from top surface 206. Front slide 220 may provide a smooth surface for contact with main panel 110. According to some embodiments, front slide 220 may be coplanar with top surface 206.

Front drawer guide 200 may include a first front support arm 224. First front support arm 224 may extend or protrude (e.g., along the vertical direction V) from top surface 206. For instance, first front support arm 224 may be located at or near a lateral center of lateral portion 208. First front support arm 224 may be predominantly parallel with vertical portion 204. Additionally or alternatively, first front support arm 224 may be spaced apart from vertical portion 204 along the lateral direction L. First front support arm 224 may include a top surface 225. For instance, according to some embodiments, drawer body 109 is provided in sliding contact with top surface 225. Moreover, top surface 225 may be spaced apart (e.g., along the vertical direction V) from top surface 206.

Front drawer guide 200 may include a second front support arm 226. Second front support arm 226 may extend or protrude (e.g., along the vertical direction V) from top surface 206. For instance, second front support arm 226 may be located at a distal end of lateral portion 208. Second front support arm 226 may be predominantly parallel with vertical portion 204 and first front support arm 224. Additionally or alternatively, second front support arm 226 may be spaced apart from first front support arm 224 along the lateral direction L. Second front support arm 226 may include a top surface 227. For instance, according to some embodiments, drawer body 109 is provided in sliding contact with each of top surface 225 and top surface 227. Moreover, top surface 227 may be spaced apart (e.g., along the vertical direction V) from top surface 206.

In detail, a first receiving channel 228 may be defined between the first front support arm 224 and the second front support arm 226. First receiving channel 228 may be a gap (e.g., a lateral gap) between first and second front support arms 224 and 226. In detail, first receiving channel 228 may extend from top surfaces 225 and 227 downward along the vertical direction V. A bottom of first receiving channel 228 may be provided below top surface 206 of lateral portion 208, e.g., along the vertical direction V. Accordingly, first front support arm 224, second front support arm 226, and at least part of lateral portion 208 may collectively form a "U" shape (e.g., as seen along the transverse direction T), thereby forming first receiving channel 228. In some embodiments, first receiving channel 228 is formed as a groove capable of receiving, for example, ball bearings. As such, it should be noted that first receiving channel 228 may have any suitable shape so as to accommodate multiple different rollers, as will be explained in detail below.

A first roller 230 may be selectively receiving within first receiving channel 228. First roller 230 may include a first axle 231. For instance, first axle 231 may extend (e.g., along the lateral direction L) from either side of first roller 230. Accordingly, first roller 230 may rotate or spin about first axle 231. A first axle cradle 232 may be provided on first front support arm 224. First axle cradle 232 may be formed along an inner lateral surface of first front support arm 224 (e.g., within receiving channel 228). First axle cradle 232 may be semi-circular so as to allow first roller 230 to spin therein. For instance, first axle cradle 232 may have a rounded "U" shape, with a concavity facing upward along the vertical direction V.

First axle cradle 232 may include a first leg 234 and a second leg 236, the first leg 234 and second leg 236 being connected by a cup 238. For instance, first and second legs 234 and 236 may extend generally along the vertical direction V, for instance, along the inner lateral surface of first front support arm 224. Cup 238 may connect first leg 234 with second leg 236, forming first axle cradle 232. According to at least some embodiments, first leg 234 and second leg 236 taper toward each other at or near a top of first front support arm 224. In detail, a distance along the transverse direction T between first leg 234 and second leg 236 at or near the top of first front support arm 224 may be less than a distance along the transverse direction T between first leg 234 and second leg 236 at or near cup 238. Thus, first axle 231 of first roller 230 may be snap-fit within first axle cradle 323. However, it should be understood that other mechanisms or methods may be utilized to hold first roller 230 within first axle cradle 232.

Similarly, a second axle cradle 240 may be provided on second front support arm 226. In detail, second axle cradle 240 may be formed along an inner lateral surface of second front support arm 226 (e.g., within receiving channel 228). Second axle cradle 240 may be semi-circular so as to allow first roller 230 to spin therein (e.g., together with first axle cradle 232). For instance, second axle cradle 240 may have a rounded "U" shape, with a concavity facing upward along the vertical direction V. Second axle cradle 240 may mirror first axle cradle 232 (e.g., about receiving channel 228). First axle 231 may thus be accepted by first axle cradle 232 and second axle cradle 240. Accordingly, a shape, formation, and composition of second axle cradle 240 may be similar or identical to first axle cradle 232, and a detailed description thereof will be omitted for brevity.

As seen in FIG. 7, when first roller 230 is received within first and second axle cradles 232 and 240, drawer body 109 may contact first roller 230. When drawer body 109 is withdrawn from and inserted into drawer recess 106, drawer body 109 (e.g., main panel 110) is rolled along first roller 230. Advantageously, a resistance felt by a user when withdrawing and inserting drawer body 109 may be reduced due to the free rolling of first roller 230 (e.g., with respect to front drawer guide 200). Additionally or alternatively, as described above, two front drawer guides 200 may be provided. Each of the two front drawer guides 200 may be identical and mirrored about a center of drawer recess 106 (e.g., along the lateral direction L). Thus, drawer body 109 may be supported by two front drawer guides 200, including two first rollers 230.

Figure 4:
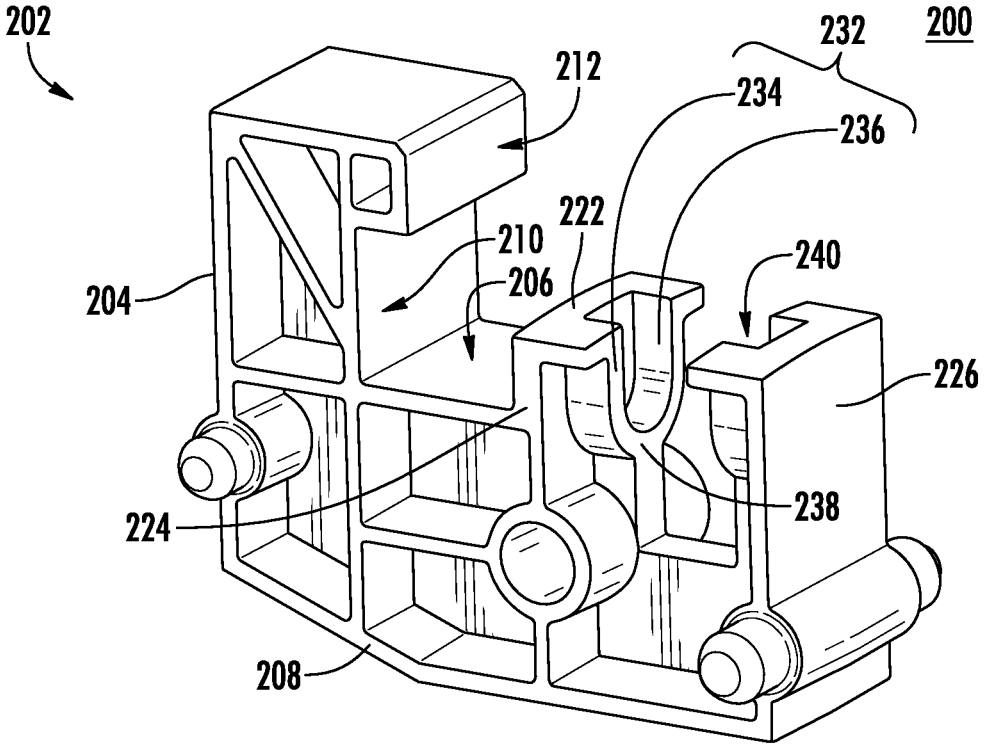
FIG. 4 provides a perspective view of a front drawer guide with the roller removed.
Figure 5:
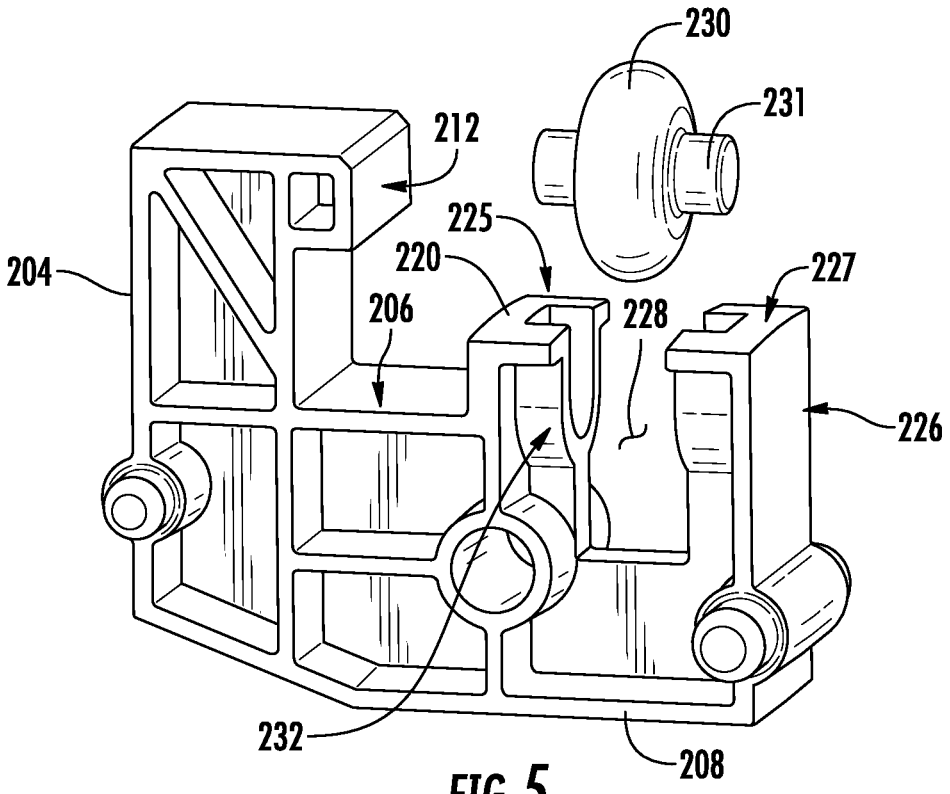
FIG. 5 provides a perspective view, including the roller, of the front drawer guide according to exemplary embodiments of the present disclosure.
Figure 6:
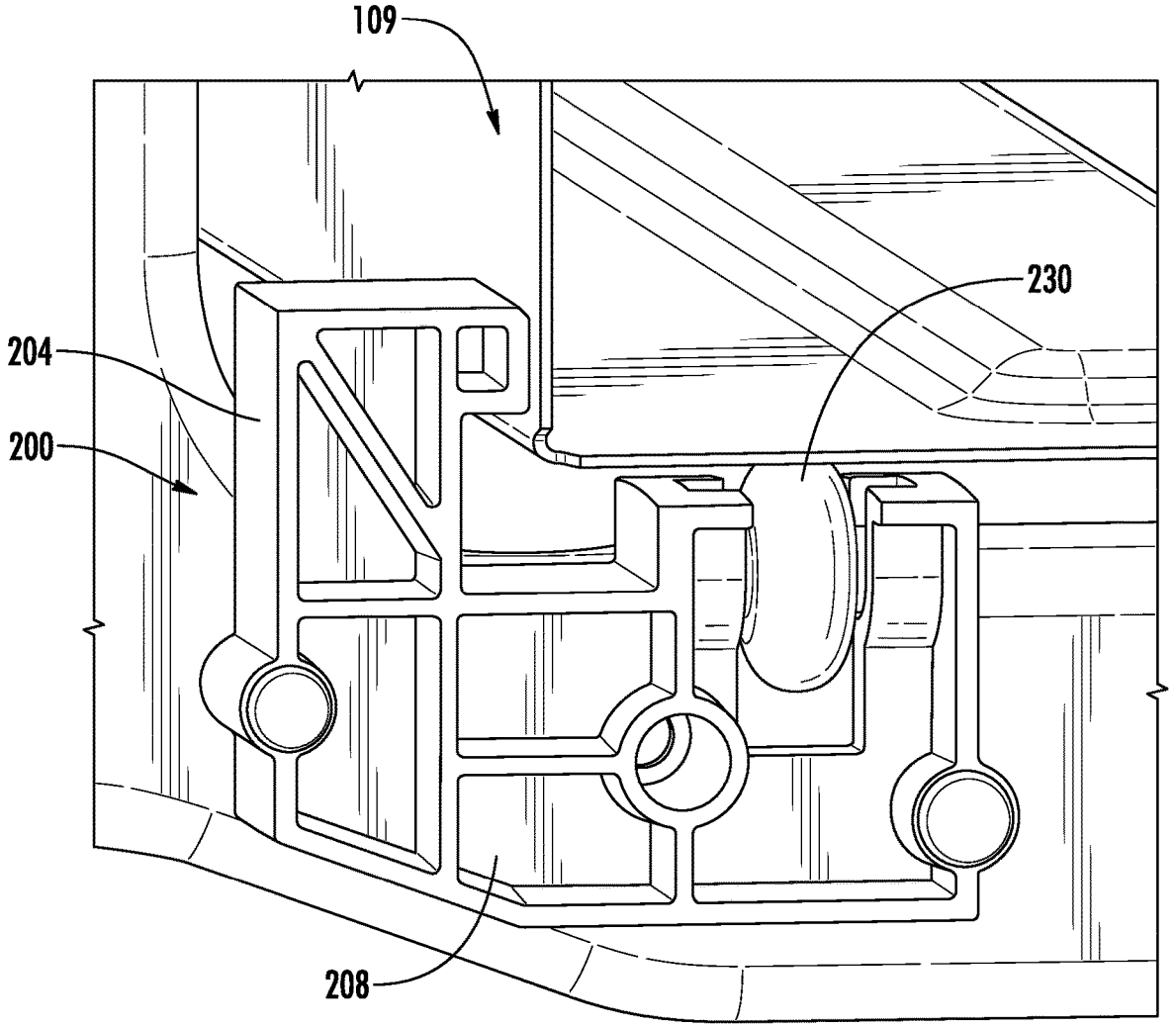
FIG. 6 provides a close-up perspective view of the front drawer guide of FIG. 4B in an attached position.

According to some embodiments, front slide 220 is defined as top surfaces 225 and 227 of first and second front support arms 224 and 226. In detail, drawer body 109 may slide along top surfaces 225 and 227 during a withdrawing or inserting motion of drawer body 109 (e.g., when first roller 230 is not inserted into first receiving channel 228). Accordingly, top surfaces 225 and 227 may be formed from a smooth plastic. Additionally or alternatively, top surfaces 225 and 227 may each have a curvature applied thereto. For instance, as shown in FIGS. 4 and 5, top surfaces 225 and 227 may each define a semi-circular curvature concave upward along the vertical direction V. According to at least some embodiments, the curvature may be defined along the transverse direction T. For example, a central portion of top surfaces 225 and 227 may be provided slightly higher than each of a front and a rear of top surfaces 225 and 227 (e.g., as measured along the transverse direction T). Advantageously, drawer body 109 may contact first roller 230, front drawer guide 200, or a combination thereof.

Figure 8:
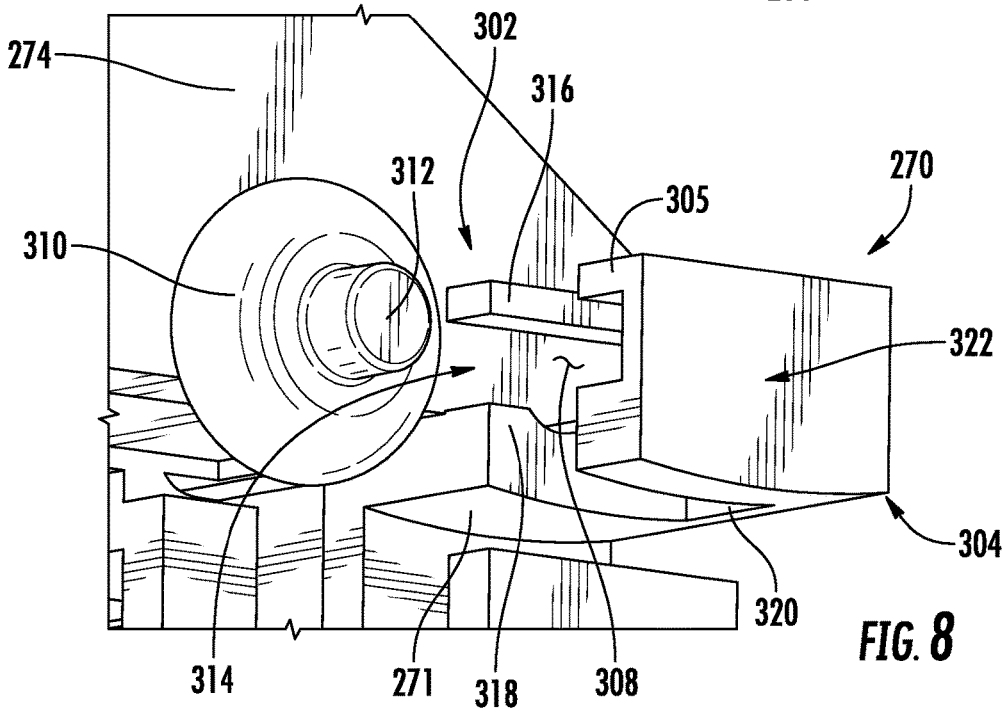
FIG. 8 provides a close-up perspective view of the rear drawer guide of FIG. 6 including a roller.

Referring now chiefly to FIGS. 7 through 9, drawer assembly 108 may include a rear drawer guide 250. Rear drawer guide 250 may include a main body 252 which defines a base 254. Base 254 may have a panel shape defined, e.g., along the lateral direction L and the transverse direction T. Base 254 may include a first portion 256 and a second portion 258. First portion 256 may be longer than second portion 258 (e.g., along the transverse direction T). First portion 256 may be located behind second portion 258 (e.g., along the transverse direction T).

Main body 252 may include a front face 260. Front face 260 may be defined along the lateral direction L and the vertical direction V. Front face 260 may extend from base 254 (e.g., along the vertical direction V). For instance, front face 260 may extend from a top face of base 254. Front face 260 may include one or more apertures defined therethrough. For instance, a first aperture 294 and a second aperture 296 may be defined through front face 260 (e.g., along the transverse direction T). First aperture 294 may be provided on one side of front face 260 (e.g., along the lateral direction L), while second aperture 296 may be provided adjacent to first aperture 294 (e.g., along the lateral direction L). Thus, a support post 300 may be defined between first aperture 294 and second aperture 296. Support post 300 may extend along the vertical direction V through front face 260.

A first protrusion 284 may extend from front face 260 (e.g., along the transverse direction T). For instance, first protrusion 284 may be attached to support post 300. First protrusion 284 may be predominantly cuboid in shape. Accordingly, first protrusion 284 may have a width along the lateral direction L such that first protrusion 284 overlaps with each of first aperture 294 and second aperture 296 (e.g., along the lateral direction L). First protrusion 284 may be configured to be inserted into latch hole 160 in rear panel 112. Accordingly, a portion of rear panel 112 may be sandwiched between first protrusion 284 and front face 260 (i.e., between first protrusion 284 and first and second apertures 294, 296).

A second protrusion 286 may extend from front face 260 (e.g., along the transverse direction T). Second protrusion 286 may be located above first protrusion 284 (e.g., along the vertical direction V). Second protrusion 286 may be located at or near a top of front face 260. Additionally or alternatively, second protrusion 286 may extend (e.g., along the transverse direction T) from an arm attached to front face 260. Second protrusion 286 may be configured to be inserted into catch hole 162 in rear panel 112. In other words, when first protrusion 284 is inserted into latch hole 160 and slid (e.g., along the vertical direction V), second protrusion 286 may be inserted into catch hole 162. Accordingly, drawer glide 120 may be locked into place on rear panel 112.

Additionally or alternatively, a fastener (e.g., screw, rivet, bolt, adhesive, or the like) may be used to connect rear drawer guide 250 to drawer body 109. The fastener (or fasteners) may be used in addition to first protrusion 284 and second protrusion 286. The fastener may pass through one or more of side panel 114, side panel 116, or rear panel 112. Accordingly, additional stability may be provided between rear drawer guide 250 and drawer body 109.

Rear drawer guide 250 may include a slide extension 262. Slide extension 262 may protrude from the bottom face of base 254 (e.g., along the vertical direction V). Slide extension 262 may be located at or near a rear of base 254 (i.e., at a distal end of first portion 256). Slide extension 262 may extend in an opposite direction from front face 260 (e.g., along the vertical direction V). Slide extension 262 may include an alignment flange or hook 264 defined thereon. Alignment flange 264 may include a first tab 266 protruding from slide extension 262 along the lateral direction L, and a second tab 268 protruding from first tab 266 along the vertical direction V. For instance, second tab 268 may protrude upward (e.g., toward base 254) from first tab 266. Second tab 268 may be predominantly perpendicular to first tab 266. Accordingly, first tab 266 and second tab 268 may collectively form and define alignment flange 264.

Slide extension 262 may further include a rear slide 270. Rear slide 270 may protrude from slide extension 262 (e.g., along the lateral direction L proximal to base 254). Rear slide 270 may extend along the transverse direction T. Rear slide 270 may be predominantly parallel to first tab 266 of alignment flange 264. Additionally or alternatively, rear slide 270 may be spaced apart from a distal end of second tab 268. A bottom face 271 of rear slide 270 may be convex (e.g., along the vertical direction V). Bottom face 271 of rear slide 270 may be configured to contact and slide along drawer slide rail 118 within drawer recess 106. Slide extension 262 may be mirrored about a plane defined along the transverse direction T and the vertical direction V. Accordingly, alignment flange 264 may be provided on each of a first side and a second side of slide extension 262 (e.g., along the lateral direction L). Each alignment flange 264 may be substantially similar, and as such a repeat description will be forgone for brevity.

Rear drawer guide 250 may include a first rear support arm 302 and a second rear support arm 304. For instance, first and second rear support arms 302 and 304 may collectively define rear slide 270. First rear support arm 302 may be predominantly parallel with second rear support arm 304. Additionally or alternatively, first rear support arm 302 may be attached to main body 252. In detail, first rear support arm 302 may extend (e.g., along the lateral direction L) directly from first side wall 272 or second side wall 274 (described below). Second rear support arm 304 may be spaced apart from first rear support arm 302 (e.g., along the lateral direction L). For instance, second rear support arm 304 may be located at a distal end of rear slide 270.

A second receiving channel 306 may be defined between the first rear support arm 302 and second rear support arm 304. Second receiving channel 306 may be a gap (e.g., a vertical gap) between first and second rear support arms 302 and 304. In detail, second receiving channel 306 may extend from front surfaces 303 and 305 rearward along the transverse direction T. Accordingly, first rear support arm 302 and second rear support arm 304 may be connected at a rearward portion of rear slide 270 (e.g., along the transverse direction T), and may collectively form a "U" shape (e.g., as seen along the vertical direction V), thereby forming second receiving channel 308. In some embodiments, second receiving channel 306 is formed as a groove capable of receiving, for example, ball bearings. As such, it should be noted that second receiving channel 306 may have any suitable shape so as to accommodate multiple different rollers, as will be explained in detail below.

A second roller 310 may be selectively receiving within second receiving channel 308. Second roller 310 may include a second axle 312. For instance, second axle 312 may extend (e.g., along the lateral direction L) from either side of second roller 310. Accordingly, second roller 310 may rotate or spin about second axle 312. A first axle cradle 314 may be provided on first rear support arm 302. First axle cradle 314 may be formed along an inner lateral surface of first rear support arm 302 (e.g., within second receiving channel 308). First axle cradle 314 may be semi-circular so as to allow second roller 310 to spin therein. For instance, First axle cradle 314 may have a rounded "U" shape, with a concavity facing upward along the vertical direction V.

First axle cradle 314 may include a first leg 316 and a second leg 318, the first leg 316 and second leg 318 being connected by a cup 320. For instance, first and second legs 316 and 318 may extend generally along the transverse direction T, for example, along the inner lateral surface of first rear support arm 302. Cup 320 may connect first leg 316 with second leg 318, forming first axle cradle 314. According to at least some embodiments, first leg 316 and second leg 318 taper toward each other at or near front surfaces 303 and 305. In detail, a distance along the vertical direction V between first leg 316 and second leg 318 at or near the front of rear slide 270 may be less than a distance along the vertical direction V between first leg 316 and second leg 318 at or near cup 320. Thus, second axle 312 of second roller 310 may be snap-fit within first axle cradle 314. However, it should be understood that other mechanisms or methods may be utilized to hold second roller 310 within first axle cradle 314.

Similarly, a second axle cradle 322 may be provided on second rear support arm 304. In detail, second axle cradle 322 may be formed along an inner lateral surface of second rear support arm 304 (e.g., within second receiving channel 308). Second axle cradle 322 may be semi-circular so as to allow second roller 310 to spin therein (e.g., together with first axle cradle 314). For instance, second axle cradle 322 may have a rounded "U" shape, with a concavity facing upward along the vertical direction V. Second axle cradle 322 may mirror first axle cradle 314 (e.g., about second receiving channel 308). Second axle 312 may thus be accepted by first axle cradle 314 and second axle cradle 322. Accordingly, a shape, formation, and composition of second axle cradle 322 may be similar or identical to first axle cradle 314, and a detailed description thereof will be omitted for brevity.

As seen in FIG. 9, when second roller 310 is received within first and second axle cradles 314 and 322, second roller 230 may contact drawer slide rail 118. When drawer body 109 is withdrawn from and inserted into drawer recess 106, second roller 310 is rolled along drawer slide rail 118. Advantageously, a resistance felt by a user when withdrawing and inserting drawer body 109 may be reduced due to the free rolling of second roller 310 (e.g., with respect to rear drawer guide 250). Additionally or alternatively, as described above, two rear drawer guides 250 may be provided. Each of the two rear drawer guides 250 may be identical. Thus, drawer body 109 may be supported by two rear drawer guides 250, including two second rollers 310.

Main body 252 of rear drawer guide 250 may further include a first side wall 272 and a second side wall 274. First side wall 272 may extend along the transverse direction T and the vertical direction V. First side wall 272 may be provided at a first side of main body 252 (e.g., along the lateral direction L). In detail, first side wall 272 may connect base 254 with front face 260. First side wall 272 may have any suitable shape. For instance, first side wall 272 may taper toward a distal end thereof along the transverse direction T. Second side wall 274 may extend along the transverse direction T and the vertical direction V. Second side wall 274 may be provided at a second side of main body 252 (e.g., along the lateral direction L), opposite first side wall 272. In detail, second side wall 274 may connect base 254 with front face 260. Second side wall 274 may have any suitable shape. For instance, second side wall 274 may taper toward a distal end thereof along the transverse direction T.

First side wall 272 may include a stabilizing arm 276. Stabilizing arm 276 may be attached to first side wall 272 and may be predominantly parallel with first side wall 272. When rear drawer guide 250 is attached to drawer body 109, stabilizing arm 276 may be provided on a first lateral side (e.g., along the lateral direction L) of the extension (or overhang) of first side panel 114, while first side wall 272 may be provided on a second lateral side (e.g., along the lateral direction L) of the extension of first side panel 114.

Accordingly, stabilizing arm 276 may provide additional lateral stability to rear drawer guide 250 with respect to drawer body 109. It should be noted that rear drawer guide 250 may be attached to either first side panel 114 or second side panel 116 (or both first side panel 114 and second side panel 116). Thus, stabilizing arm 276 may protrude from each of first side wall 272 and second side wall 274 of main body 252 of rear drawer guide 250.

Additionally or alternatively, a catch 282 may protrude from a distal end of stabilizing arm 276. Catch 282 may protrude along the lateral direction L from stabilizing arm 276. Catch 282 may protrude in a direction inward (e.g., toward main body 252 of rear drawer guide 250). Catch 282 may ensure constant contact of main body 252 and stabilizing arm 276 with drawer body 109 (e.g., first side panel 114 or second side panel 116). As described above, stabilizing arm 276 may be provided in addition to a fastener (e.g., screw, rivet, bolt, adhesive, or the like) to increase stability between rear drawer guide 250 and drawer body 109.

A locator pin 288 may protrude from second portion 258 of base 254. For instance, locator pin 288 may protrude along the vertical direction V from a top face of second portion 258. Locator pin 288 may have a cylindrical shape with an axis oriented normal to the top face of second portion 258. However, the shape of locator pin 288 is not limited, and any suitable shape may be used for locator pin 288. Locator pin 288 may assist in locating a position of rear drawer guide 250 with drawer body 109. In some embodiments, locator pin 288 fits into a locator hole or slot defined in main panel 110 of drawer body 109. Additionally or alternatively, locator pin 288 may fit into a groove formed into a bottom face of main panel 110 of drawer body 109.

According to the embodiments described herein, a drawer assembly for an oven appliance including multiple modular drawer guides is provided. The drawer assembly includes a drawer body, a pair of rear drawer guides attached to the drawer body, and a pair of front drawer guides attached to the oven appliance. The rear drawer guides may include a rear slide. The rear slide may selectively slide together with the drawer body along a slide rail provided within a drawer cavity. The rear drawer guides may include a removable roller attached thereto. The removable roller may contact the slide rail in place of the rear slide, allowing a rolling contact between the drawer body and the slide rail instead of a friction sliding contact. Each of the pair of front drawer guides may include a front slide. A removable roller may be attached to each of the front slides. The removable roller may contact a bottom panel of the drawer body in place of the front slides, allowing a rolling contact between the drawer body and the pair of front drawer guides instead of a friction sliding contact.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A drawer assembly for an appliance, the drawer assembly defining a vertical direction, a lateral direction, and a transverse direction, the appliance comprising a frame defining an opening, the drawer assembly comprising:

a front drawer guide configured to be fixed to the frame of the appliance proximate the opening, the front drawer guide comprising a front slide, wherein the front slide defines a first sliding surface and a first receiving channel defined within the sliding surface;

a first roller selectively inserted into and removed from the first receiving channel;

a drawer body comprising a rear panel, wherein the drawer body is in slidable contact with the first sliding surface when the roller is removed from the first receiving channel, wherein the drawer body is in rolling contact with the first roller when the first roller is inserted into the first receiving channel; and a rear drawer guide coupled to the drawer body, the rear drawer guide comprising an alignment flange and a rear slide provided above the alignment flange along the vertical direction, wherein the rear slide defines a second sliding surface and a second receiving channel, the second receiving channel extending rearward along the transverse direction.

2. The drawer assembly of claim 1, wherein the front drawer guide comprises:

a first front support arm extending along the vertical direction; and a second front support arm extending along the vertical direction, the second front support arm being spaced apart from the first front support arm along the lateral direction, wherein the first receiving channel is defined between the first and second front support arms.

3. The drawer assembly of claim 2, wherein the front drawer guide further comprises:

a first axle cradle provided on the first front support arm; and a second axle cradle provided on the second front support arm, wherein the first axle cradle and the second axle cradle face each other along the lateral direction.

4. The drawer assembly of claim 3, wherein the first roller comprises an axle, the axle being received within the first and second axle cradles.

5. The drawer assembly of claim 2, wherein the first sliding surface is defined along a top side of each of the first and second front support arms.

6. The drawer assembly of claim 1, wherein the front drawer guide comprises a lateral support surface, the lateral support surface being in sliding contact with the drawer body.

7. The drawer assembly of claim 6, wherein the front drawer guide comprises:

a first said front drawer guide provided at a first lateral side of the drawer body and comprising a first said lateral support surface; and a second said front drawer guide provided at a second lateral side of the drawer body and comprising a second said lateral support surface, and wherein a width along the lateral direction between the first lateral support surface and the second lateral support surface is 1% to 5% greater than a width along the lateral direction of the drawer body.

8. The drawer assembly of claim 1, further comprising:

a second roller removably inserted into the second receiving channel, the second roller configured to be in rolling contact with the frame of the appliance.

9. The drawer assembly of claim 8, wherein the rear slide comprises:

a first support arm extending along the transverse direction; and a second support arm extending along the transverse direction, the second support arm being spaced apart from the first support arm along the lateral direction, wherein the second receiving channel is defined between the first and second support arms.

10. The drawer assembly of claim 9, wherein the rear drawer guide further comprises:

a first axle cradle provided on the first support arm; and a second axle cradle provided on the second support arm, wherein the first axle cradle and the second axle cradle face each other along the lateral direction.

11. The drawer assembly of claim 10, wherein the second roller comprises an axle, the axle being received within the first and second axle cradles via a snap-fit.

12. The drawer assembly of claim 9, wherein the second sliding surface is defined along an underside of each of the first and second support arms.

13. The drawer assembly of claim 12, further comprising a rail, the rail being positioned below the second sliding surface along the vertical direction.

14. The drawer assembly of claim 1, wherein the rear drawer guide is coupled to the rear panel of the drawer body.

15. An oven appliance defining a vertical direction, a lateral direction, and a transverse direction, the oven appliance comprising:

a cabinet, the cabinet defining a cooking chamber and a drawer recess provided beneath the cooking chamber;

a frame member extending along the transverse direction within the drawer recess; and a drawer assembly removably provided within the drawer recess, the drawer assembly comprising:

a front drawer guide fixed to the frame member proximate a front of the oven appliance, the front drawer guide comprising a front slide, wherein the front slide defines a first sliding surface and a first receiving channel;

a first roller selectively inserted into and removed from the first receiving channel;

a drawer body comprising a rear panel, wherein the drawer body is in slidable contact with the first sliding surface when the first roller is removed from the first receiving channel, wherein the drawer body is in rolling contact with the first roller when the first roller is inserted into the first receiving channel; and a rear drawer guide coupled to the drawer body, the rear drawer guide comprising a hook and a rear slide provided over the hook along the vertical direction, wherein the rear slide defines a second sliding surface and a second receiving channel.

16. The oven appliance of claim 15, wherein the front drawer guide comprises:

a first support arm extending along the vertical direction; and a second support arm extending along the vertical direction, the second support arm being spaced apart from the first support arm along the lateral direction, wherein the first receiving channel is defined between the first and second support arms.

17. The oven appliance of claim 15, further comprising:

a second roller removably inserted into the second receiving channel, the second roller being in rolling contact with the frame member.

18. The oven appliance of claim 17, wherein the rear slide comprises:

a first support arm extending along the transverse direction; and a second support arm extending along the transverse direction, the second support arm being spaced apart from the first support arm along the lateral direction, wherein the second receiving channel is defined between the first and second support arms.

* * * * *